US005435232A

United States Patent [19]

Hammerton

[11] Patent Number: 5,435,232

[45] Date of Patent: Jul. 25, 1995

[54] MULTI-CONNECTING ROD RECIPROCATING MACHINE

[76] Inventor: Ian R. Hammerton, 130 Pine Ave., Mildura, Victoria 3500, Australia

[21] Appl. No.: 115,259

[22] Filed: Sep. 2, 1993

Related U.S. Application Data

[63] Continuation of Ser. No. 842,136, Mar. 25, 1992, abandoned.

[30] Foreign Application Priority Data

Sep. 29, 1989 [AU] Australia ..... PJ6663

[51] Int. Cl.[6] ..... F01B 9/00

[52] U.S. Cl. ..... 92/140; 92/147; 92/149; 92/76; 123/197.4; 74/44; 74/51

[58] Field of Search ..... 92/147, 149, 140, 76; 123/197.3, 197.4; 74/44, 51

[56] References Cited

U.S. PATENT DOCUMENTS

| | | | |
|---|---|---|---|
| 706,638 | 8/1902 | Clough | 74/44 |
| 2,392,921 | 1/1946 | Holman | 74/44 |
| 4,505,239 | 3/1985 | Deland | 123/197.4 |
| 4,690,113 | 9/1987 | DeLand | 123/197.4 |

FOREIGN PATENT DOCUMENTS

| | | | |
|---|---|---|---|
| 2407341 | 6/1979 | France | 92/140 |
| 2746476 | 4/1979 | Germany | 92/140 |
| 3000531 | 7/1981 | Germany | 92/140 |
| 0083634 | 5/1982 | Japan | 123/197.4 |
| 5129 | 3/1901 | United Kingdom | 74/44 |

*Primary Examiner*—Thomas E. Denion
*Attorney, Agent, or Firm*—Nikaido, Marmelstein, Murray & Oram

[57] ABSTRACT

A reciprocating piston (2) without any skirt is stabilized throughout its reciprocating motion by two or more connecting rods (4) connected between parallel spaced apart small ends (10) and parallel spaced apart crankshafts (5).

19 Claims, 7 Drawing Sheets

MULTI-CONNECTING ROD RECIPROCATING MACHINE

This application is a continuation of application Ser. No. 07/842,136 filed Mar. 25, 1992, abandoned.

FIELD OF THE INVENTION

This invention relates generally to reciprocating piston machines. It finds particular application in both positive displacement fluid pumps and gas expansion engines (internal combustion, steam etc.).

PRIOR ART

The mainstay of our positive displacement fluid pumps and internal combustion engines rely upon a reciprocating piston within a cylinder bore with a head sealing off one end of the bore in order to provide a variable volume working chamber and having a connecting rod extending from the piston in the direction of the bore opposite the head to connect with an offset crank pin of a rotary crank shaft.

The traditional practice is to have a single connecting rod pivotally connected to the piston at its small end and pivotally connected to the crank pin at its big end. The connecting rod serves to convert the rotary motion of the crank assembly to, or from, the reciprocating motion of the piston. The piston traditionally includes a long skirt fitting closely within the cylinder bore so as to maintain the piston in axial alignment with the bore with its working top surface extending generally transversely across the bore. Any forces tending to tilt the piston working surface are counteracted by reaction forces of the cylinder bore wall against the skirt. Such reaction forces result in frictional resistance in the reciprocating motion of the piston and resultant energy loss and accelerated wear of the piston.

Also, the traditional crank assembly connecting rod mechanism results in a number of cyclic out of balance forces causing various modes of vibration in the engine. While careful balancing of the crank mechanism itself can go a long way to reducing this vibration the necessary acceleration of the connecting rod transversely across the bore in a cyclic to and fro manner is more difficult to counteract. Additionally this necessary cyclic acceleration of the connecting rod also transfers reaction forces to the piston, these forces again being resisted the piston skirt and producing additional energy waste and increased wear.

DISCLOSURE OF INVENTION

The inventor contemplates the use of two or more connecting rods between each piston and at least two mechanically synchronised crank mechanisms in a configuration which will enhance stability of the piston during its reciprocation.

According to one broad form of the invention there is provided a piston adapted for reciprocation in a mating cylinder of the machine, the piston including at least two small end housings having parallel spaced apart small end axes.

Such piston is adapted to receive a small end of a connecting rod in each small end housing, such that the connecting rod small ends pivot in the piston about the small end axes, the plurality of small end axes providing stability in the piston in one transverse direction, the conventional small end pivot about a line axis providing stability in the piston in the perpendicular transverse direction.

One particular embodiment of the invention is provided by a reciprocating piston machine having at least a pair of connecting rods each having axially parallel spaced apart small end pivotal connections with a common piston and axially parallel spaced apart big end pivotal connections with respective crank pins, each adapted to orbit circularly about a respective crank axis, the connecting rods, crank pins and crank axes being configured such that during piston reciprocation the piston is maintained in a constant orientation.

In one embodiment the connecting rods are maintained positioned symmetrically about a central longitudinal axis of the cylinder bore by virtue of the crank pins orbiting in opposite rotational directions.

In an alternative embodiment the connecting rods are maintained parallel by virtue of the crank pins orbiting in like circular directions and being spaced apart a distance equal to the spaced apart distance of the small ends of the connecting rods.

In further embodiments of the invention the connecting rods may overlap by virtue of the big end and small end of each rod being on opposite transverse sides of the cylinder bore.

The invention can be used in multiple cylinder machines in many different configurations such as in line, square and "V" configurations.

BRIEF DESCRIPTION OF THE DRAWINGS

The following are illustrative examples of embodiments of the invention described with reference to the drawings in which.

BEST MODE OF CARRYING OUT THE INVENTION

Figure 1:
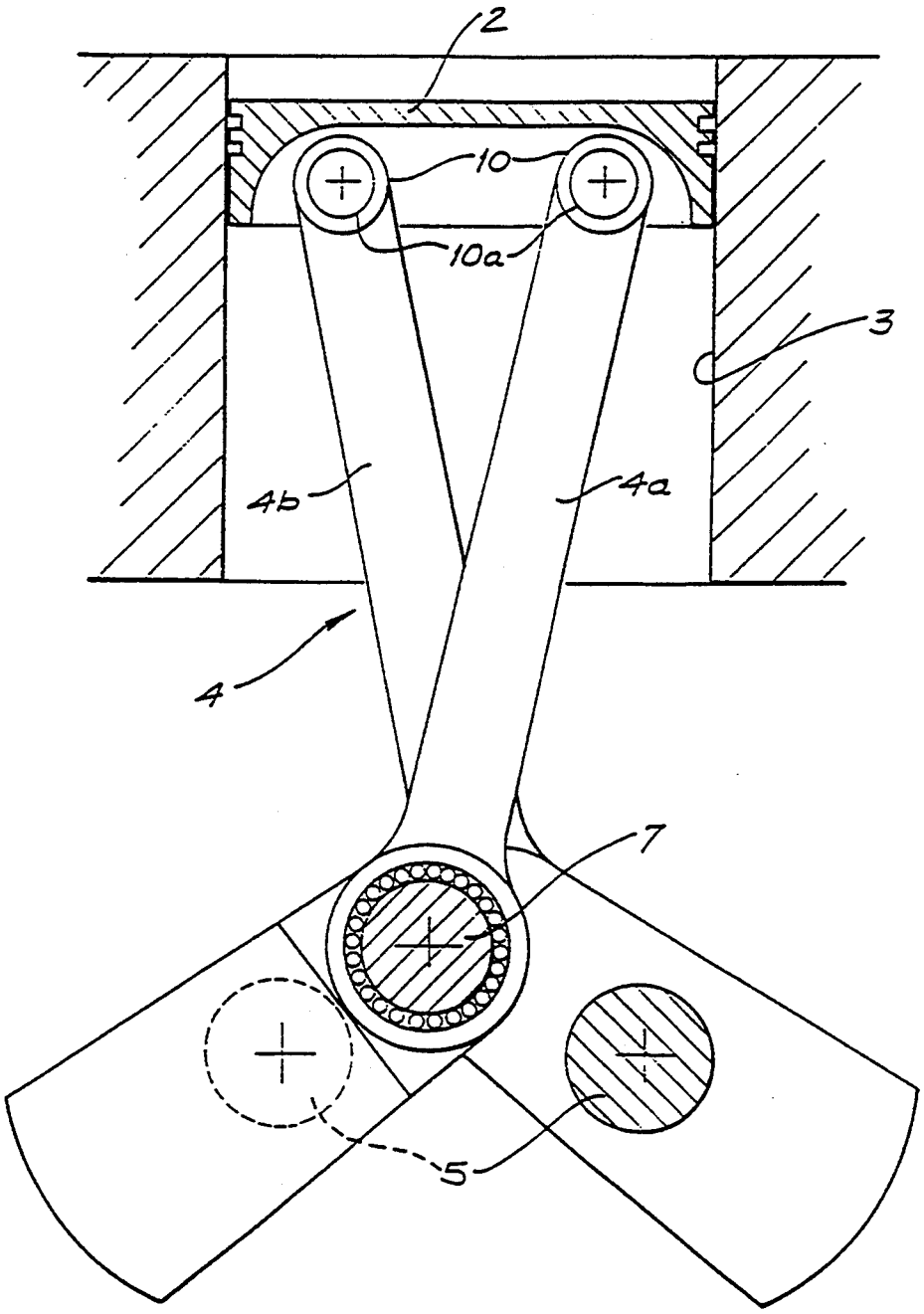
FIG. 1 is a transverse sectional view of a single cylinder reciprocating piston machine incorporating the invention.
Figure 1A:
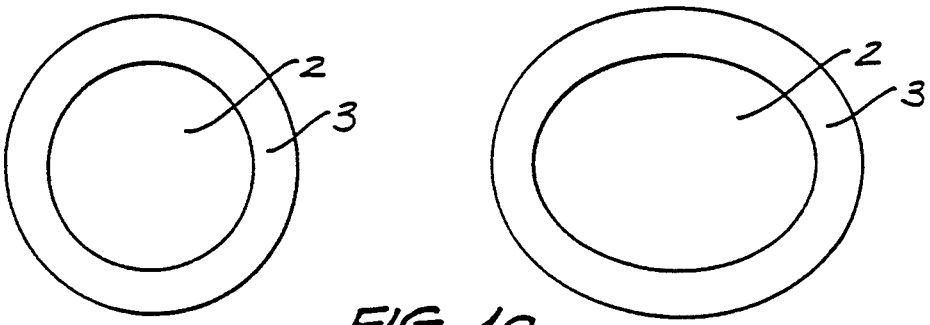
Figure 2:
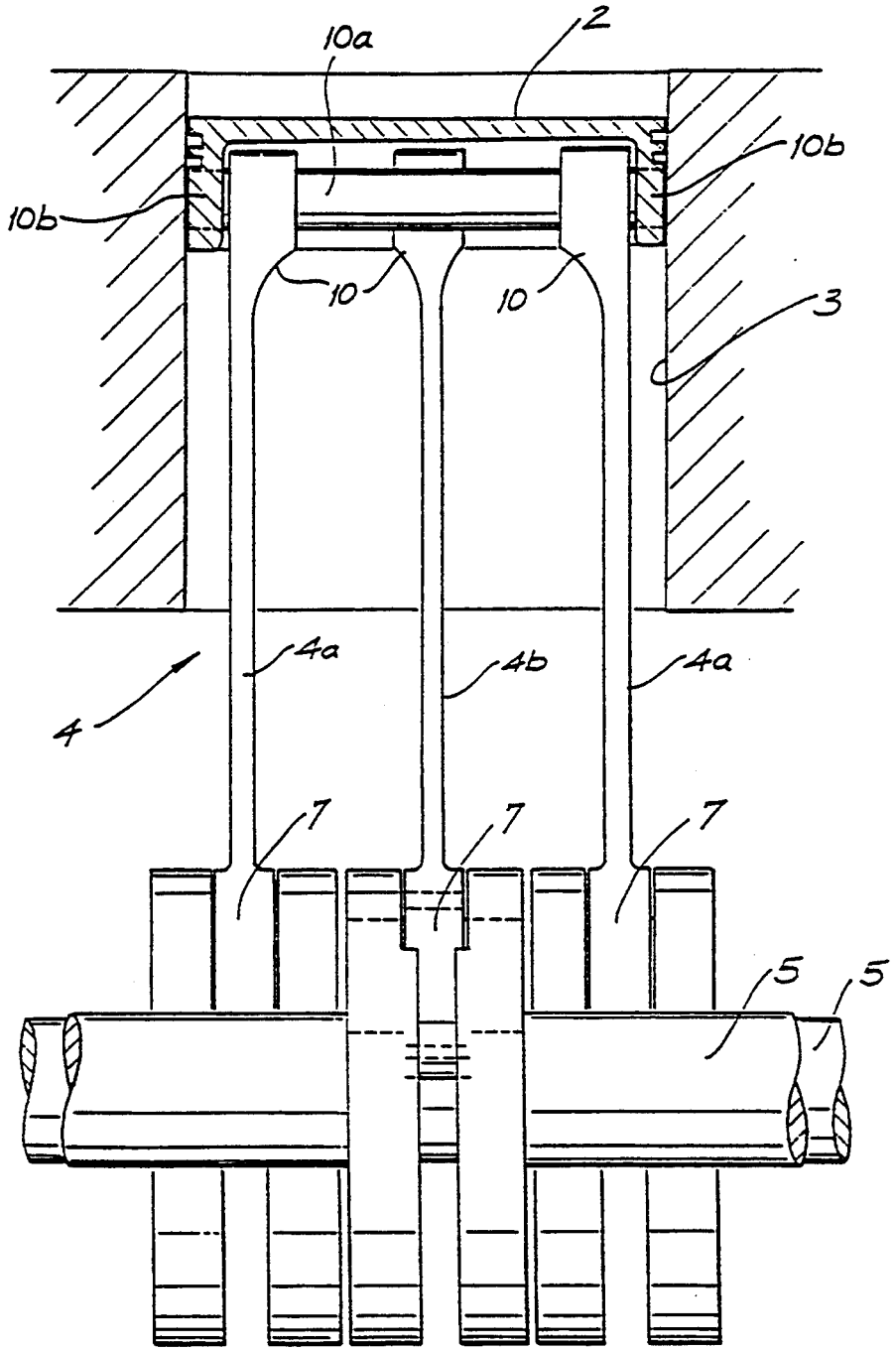
FIG. 2 is a sectional end view of the machine of FIG. 1.

FIGS. 1 and 2 show an embodiment of the invention in which a short piston 2 is stabilised throughout its reciprocating motion by a system of three connecting rods 4. Piston 2 may be circular, oval or other configuration, as shown FIG. 1*a*. The connecting rods 4 are arranged with two outside parallel rods 4*a* and a single inside rod 4*b*. The connecting rods 4 are each connected via a respective small end 10 and gudgeon 10*a*, pressed into a housing 10*b* integral of the underside of the piston 2. Each small end 10 pivots in the conventional manner, the pivot axes of the three small ends 10 being parallel and the small ends of the outer con rods 4*a* being co-axial.

Each connecting rod 4 has a big end pivoting on a respective crank pin 7, the crank pins 7 of the outer connecting rods 4*a* being co-axial and the big end 7 of the inner connecting rod 4*b* being parallel axially to the other two. The co-axial big ends 7 of the outer connecting rods 4*a* rotate about a common crank shaft 5 while the big end 7 of the inner connecting rod 4*b* rotates about a second crank shaft 5. The two crank shafts 5 are geared together to rotate in a one to one speed ratio and in opposite directions, that is contra-rotating.

By correct selection of component masses the system will provide near perfect balance and minimum vibration while maintaining a stable piston 2 notwithstanding the absence of the conventional piston skirt.

Figure 3:
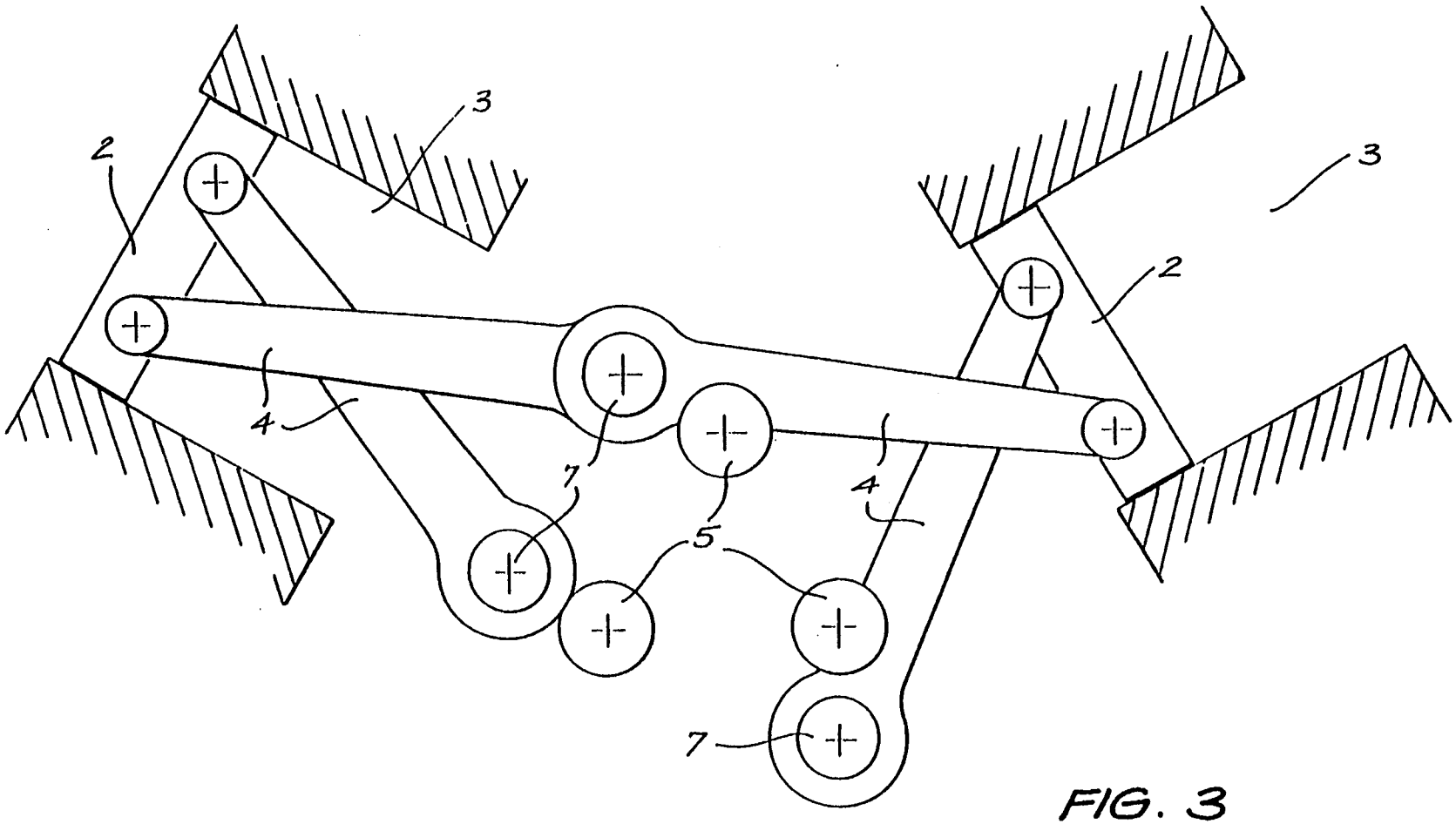
FIG. 3 is a transverse sectional sketch of another embodiment of the invention.

FIG. 3 shows a shallow V two cylinder engine configuration using three crank shafts 5. Again the pistons 2 are very short without any piston skirt. One of the crank shafts 5 share connecting rods 4 from each of the pistons 2 while the two remaining crank shafts 5 each have a connecting rod leading only to one respective piston 2. Each piston 2, connecting rod 4, and crank mechanism 5 and 7, perform substantially in the same manner as that described with reference to the machine shown in FIGS. 1 and 2. The machine sketched in FIG. 3 shows only two connecting rods 4 for each piston 2 although the machine could equally well include three connecting rods 4 per piston 2 in the manner described in the previous machine of FIGS. 1 and 2.

Figure 4:
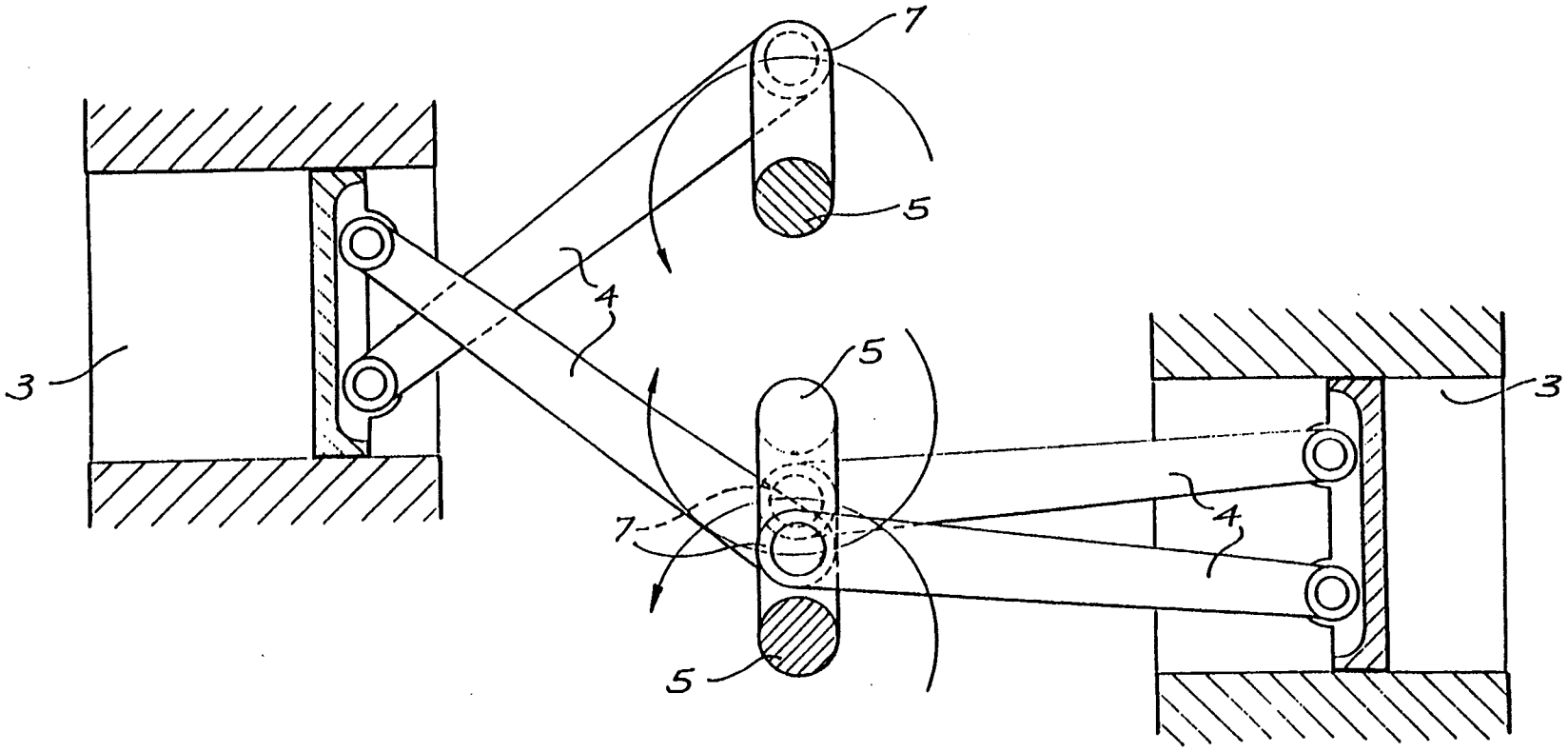
FIG. 4 is a transverse sectional sketch of a further embodiment of the invention.

The machine of FIG. 4 is somewhat similar to that of FIG. 3 in that there is provided two pistons 2 and three crank shafts 5. In contrast however the machine of FIG. 4 is of an offset horizontally opposed configuration.

Figure 5:
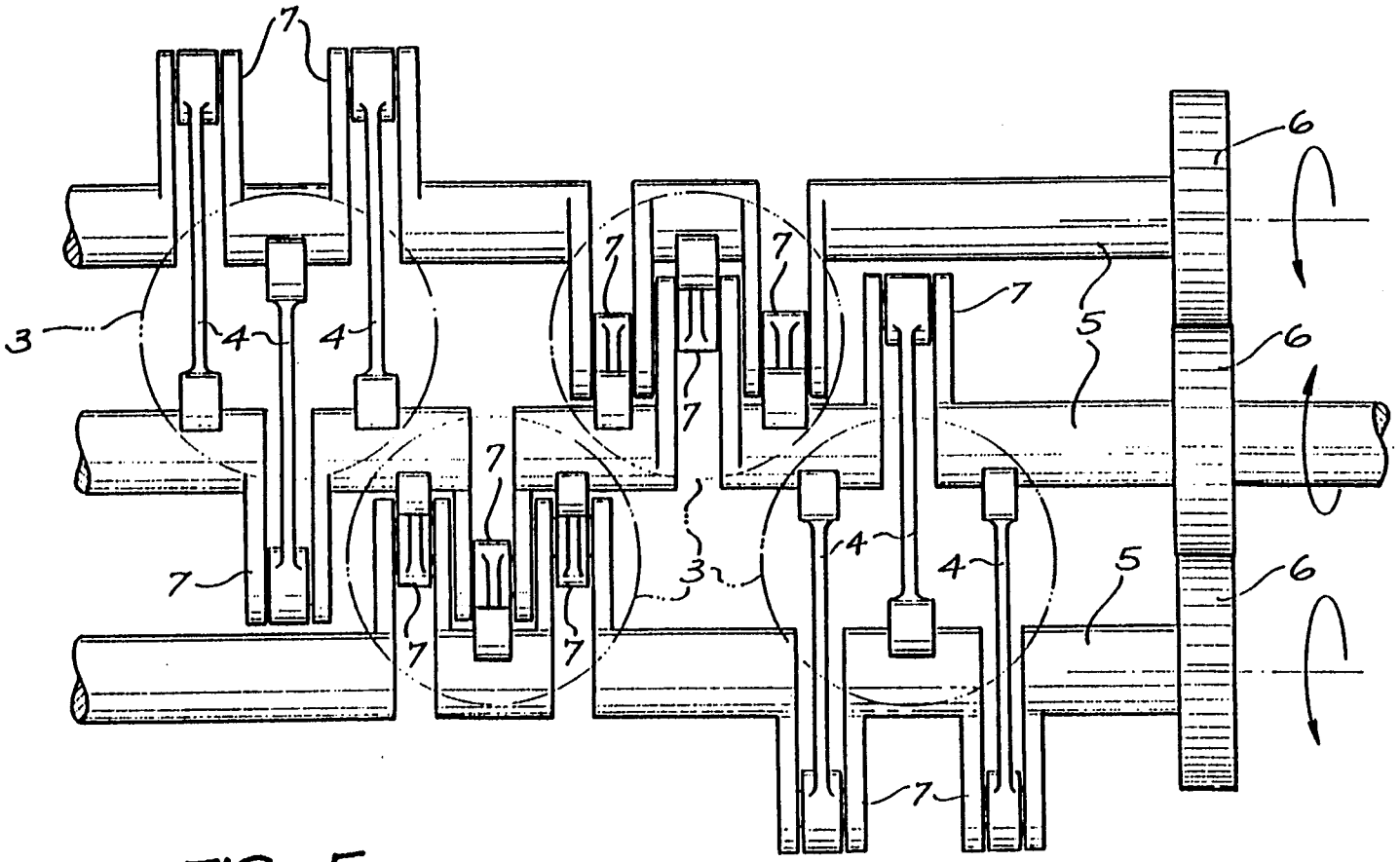
FIG. 5 is a plan sketch of still another embodiment of the invention.

The machine of FIG. 5 can be described as a substantially in line, although somewhat offset, four cylinder machine. For each cylinder 3, and reciprocating piston not shown, there are three connecting rods 4 arranged one between a parallel pair as in the previously described machines. The inner connecting rods share a common crank shaft 5 positioned generally centrally of the overall machine, while the outer pairs of connecting rods 4 are shared between two outer crank shafts 5. All three crank shafts 5 are interconnected by a gear train 6 to provide common rotation of the two outer crank shafts 5 and contra-rotation of the central crank shaft 5. A main shaft 1 is provided integrally of the central crank shaft 5 and forms, in the case of an internal combustion engine, the power output shaft.

In a conventional reciprocating piston machine the average orientation of the connecting rod relative to the rotation of the crank shaft is in alignment with the cylinder axis. Thus, with a constant crankshaft speed the average piston speed is equal during upward and downward half cycles of the piston reciprocating motion. Further, the average piston speed is equal during the upper half and lower half of the cycle. This may be described as symmetrical recipricutory to rotary motion.

Four different cyclic positions of a machine are shown in FIGS. 6*a–d*. In each figure a piston 2 connected by a pair of connecting rods 4*a*, 4*b* to respective big ends 7. The crank shafts 5*a*, 5*b* are contra-rotating at a 1:1 speed ratio and maintain the connecting rods 4*a* and 4*b* symmetrical to each other about the central axis of the cylinder.

Figure 6A:
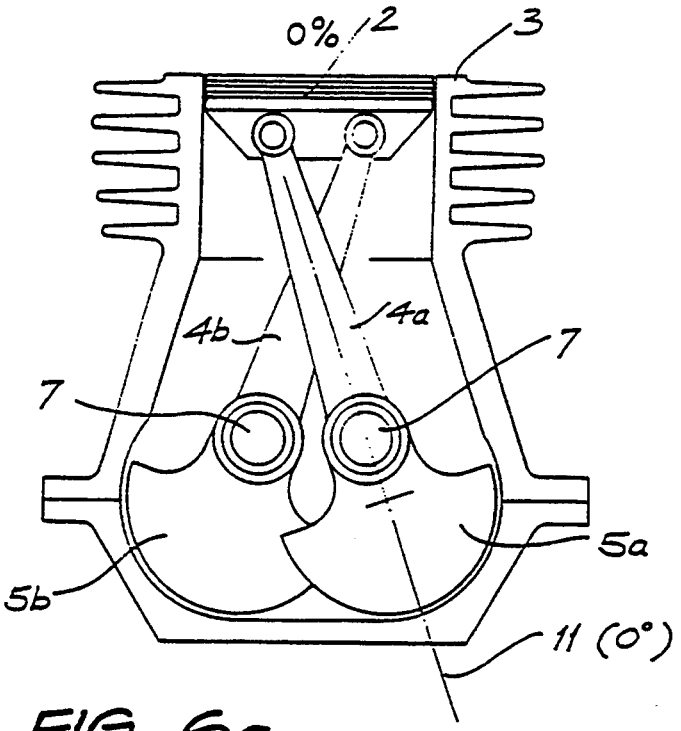
FIGS. 6*a–d* are cross-sectional views of an embodiment of the invention in four cyclic positions.

At the position shown in FIG. 6*a* the piston 2 is at the top of its travel and thus has a displacement of 0%. At this point the axis 11 shows the top dead centre orientation of the crankshaft 5*a*.

Figure 6B:
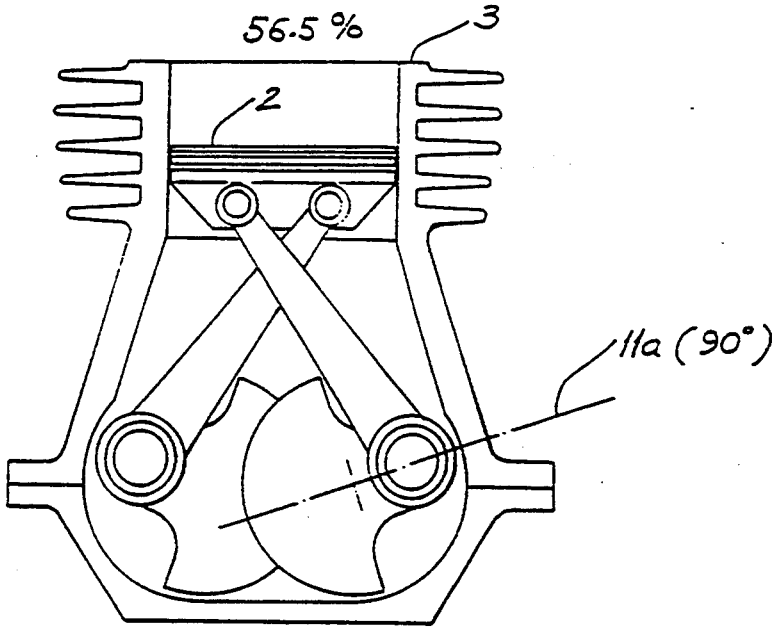

FIG. 6*b* shows the machine with the crankshaft 5*a* rotated through 90° with its axis 11 now at 11*a*. At this point piston 2 has progressed down its reciprocating path to give a displacement volume of 56.5%.

In a conventional single connecting rod machine the piston displacement is 50% at a crankshaft rotation of 90° from the top dead centre position.

Figure 6C:
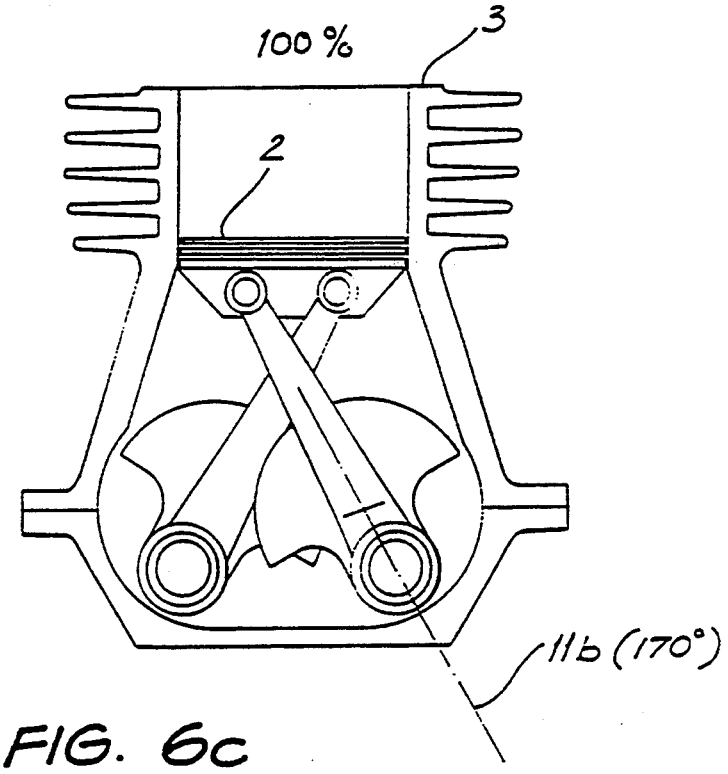

The position in FIG. 6*c* shows the displacement of piston 2 at the 100% displacement position, that is at the bottom of its reciprocating path. At this point the axis 11 of crankshaft 5*a*, shown as 11*b*, is at approximately 170° rotation. Thus while the piston 2 has undergone a complete top to bottom half reciprocation cycle, the crankshaft has only proceeded through an approximately 170° rotation.

Figure 6D:
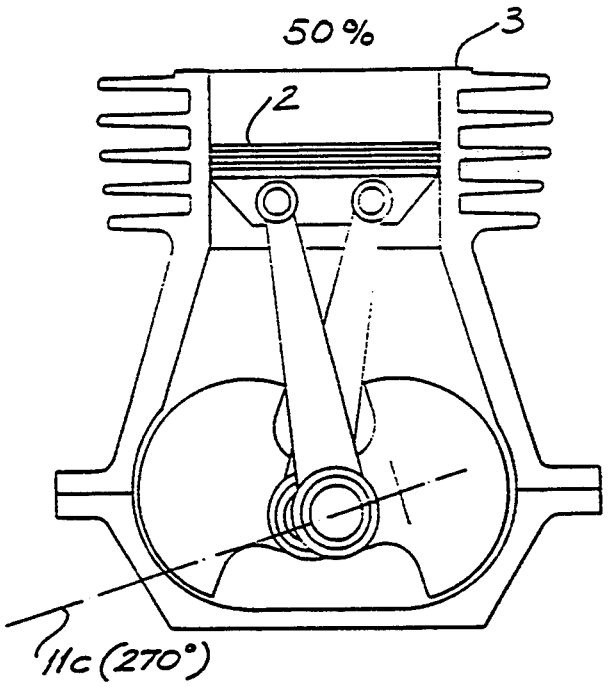

FIG. 6*d* shows the piston 2 having proceeded upwardly to the 50% displacement position coinciding with crankshaft 5*a* axis 11*c* being at the 270°, or $\frac{3}{4}$ revolution, position.

Thus it can be seen that two important non symmetrical relationships exist between the movement of the piston 2 and the crankshafts 5 which differ from the corresponding relationships in a conventional machine. Firstly, with constant crankshaft 5 rotational speed, the downward movement of the piston 2 from top dead centre to bottom dead centre (FIGS. 6*a* and 6*c*) corresponds to a shorter period of time than does the upward return to the top dead centre position. The downward travel corresponding to a 170° rotation of the crankshaft 5 while the upward travel corresponds to a 190° rotation of crankshaft 5. In the case where the machine of FIG. 6 operates in the opposite direction, that is with crankshaft 5*a* rotating anti-clockwise and crankshaft 5*b* rotating clockwise, the relative speeds of the piston 2 during upward and downward half cycles would be reversed.

Secondly, the time taken for the machine to proceed from the position shown in FIG. 6*b* to that shown in FIG. 6*d* is equal to the time taken for the machine to return back to the position shown in FIG. 6*b*, both movements corresponding to a 180° crankshaft rotation. However, the displacement volume caused by piston 2 differs in the two top and bottom half cycles. The movement from position FIG. 6*b* to position FIG. 6*d* produces displacement from the 56.5% through 100% back to 50%, while the second described movement returning to position FIG. 6*b* produces piston displacement of 50% through 0% returning to 56.5%. Thus there is a smaller change in piston displacement during the bottom half cycle, on a time basis, than during the top half cycle, that is the average piston speed during the top half cycle is faster than it is during the bottom half cycle.

While the actual displacement percentages in relation to crankshaft rotation positions described above are dependent upon the actual dimensions and placement of various components, the principal remains the same. These two effects can be used to advantage in particular embodiments for example in a 2-stroke internal combustion engine, combustion performance can be improved by virtue of the average piston speed being lower during the bottom half of the cycle allowing more complete exhausting of combustion gases and a higher percentage fill of the induction charge.

Where traditional symmetrical piston/crankshaft speeds are required, the connecting rods can be disposed with their small end and crankshaft centre located on the same side of the cylinder centre line, and equally distanced therefrom, thus at top and bottom dead centre positions, all the connecting rods are aligned with the cylinder axis.

It will be evident that there are many feasible geometrical arrangements of the connecting rods which have not been covered in the above examples but which lie fully within the scope of the generally described invention.

Similarly the actual cylinder bore configurations, number of cylinders per machine, and mode of transferring power to or from the machine are equally open to variations by design choice without departing from the general scope of the invention.

An example of such design choice would be a machine having common rotating crank shafts for each piston, the connecting rods being maintained parallel to one another, each to their own lateral side of the machine, without crossing over during machine operation.

I claim:

1. A machine comprising a cylinder, a piston reciprocable within said cylinder, a pair of crankshafts, at least two connecting rods, said piston being connected to said pair of crankshafts by said at least two connecting rods, and at least two gudgeon pins located on parallel, laterally spaced apart small end axes of rotation directly connected to said piston, each said connecting rod having a small end pivotally attached to a respective gudgeon pin and a big end eccentrically rotatably connected to a respective crankshaft of the crankshaft pair, said connecting rods being spaced apart in the direction of the small end axes to allow each of said connecting rods to cross over at least one of said connecting rods without contact while pivoting about their respective gudgeon pins and crankshafts.

2. A machine as claimed in claim 1 said piston having a circular cross-section.

3. A machine as claimed in claim 1 said piston having a substantially oval cross-section.

4. A machine as claimed in claim 1 said piston having substantially no skirt.

5. A machine comprising a cylinder, a piston reciprocable within said cylinder, a pair of crankshafts, at least two connecting rods, said piston being connected to said pair of crankshafts by said at least two connecting rods, wherein said piston includes at least two gudgeon pins located on parallel, laterally spaced apart small end axes of rotation, each said connecting rod having a small end pivotally attached to a respective gudgeon pin and a big end eccentrically rotatably connected to a respective crankshaft of the crankshaft pair, said connecting rods being spaced apart in the direction of the small end axes to allow each of said connecting rods to cross over at least one of said connecting rods without contact while pivoting about their respective gudgeon pins and crankshafts, wherein there are three said connecting rods connecting said piston to said crankshaft pair.

6. A machine comprising a cylinder, a piston reciprocable within said cylinder, a pair of crankshafts, at least two connecting rods, said piston being connected to said pair of crankshafts by said at least two connecting rods, and wherein said piston includes at least two gudgeon pins located on parallel, laterally spaced apart small end axes of rotation, each said connecting rod having a small end pivotally attached to a respective gudgeon pin and a big end eccentrically rotatably connected to a respective crankshaft of the crankshaft pair, said connecting rods being spaced apart in the direction of the small end axes to allow each of said connecting rods to cross over at least one of said connecting rods without contact while pivoting about their respective gudgeon pins and crankshafts, wherein there are first and second small end axes, first and second crankshafts and three connecting rods disposed as one parallel pair of connecting rods attached coaxially at their big ends to the first crankshaft and pivotally attached at their small ends about the first small end axis and a third connecting rod lying axially between the pair of connecting rods and being connected to the second crankshaft and pivoting about the second small end axis, the first and second crankshafts being cooperatively attached for contra-rotation.

7. A machine as claimed in claim 6, wherein the small end axes are disposed symmetrically of the piston, the crankshafts are disposed symmetrically of the cylinder and the connecting rods cross over with their respective small ends and big ends being on opposite sides of the cylinder axis.

8. A machine as claimed in claim 6, wherein the small end axes are disposed separated by a distance different to a separation distance between axes of the crankshafts.

9. A reciprocating piston machine comprising a plurality of cylinders, a plurality of pistons, at least two crankshafts, at least two connecting rods associated with each piston, each piston reciprocable within a respective cylinder and connected to a pair of said crankshafts by said at least two connecting rods, at least two gudgeon pins for each piston located on parallel, laterally spaced apart small end axes of rotation and directly connected to a respective piston, each said connecting rod having a small end pivotably attached to a respective gudgeon pin and a big end eccentrically and pivotably connected to a respective crankshaft of the crankshaft pair, said connecting rods being spaced apart in a direction of the small end axes to allow each one of the connecting rods to cross over at least another of said connecting rods without contact while pivoting about their respective gudgeon pins and crankshafts.

10. A machine as in claim 9 wherein the cylinders are angularly disposed about a bottom end of the machine which houses the crankshafts, and pistons of angularly adjacent cylinders share a crankshaft disposed angularly centrally of the two cylinders.

11. A machine as in claim 9 wherein a plurality of cylinders are disposed in line and each piston shares a common said pair of crankshafts.

12. A machine as in claim 9 wherein the big end and small end of each connecting rod are disposed such that the average angle of the connecting rod relative to the cylinder axis with respect to rotation of the crankshaft is non-zero so that piston reciprocation is non-symmetrical to crankshaft rotation.

13. A machine as in claim 9 wherein each small end is a distance from the centre of the cylinder not equal to the distance of the connected crankshaft from the centre of the cylinder.

14. A machine as in claim 9 wherein each connecting rod is disposed across the cylinder.

15. A machine as in claim 14 wherein, during operation, the average piston speed during a top half of its reciprocating motion is higher than the average piston speed during the complementary bottom half of its reciprocating motion.

16. A machine as in claim 14 being a two-stroke internal combustion machine.

17. A machine as in claim 14 wherein, during operation, the average piston speed during upward reciprocating motion of the piston is slower than the average piston speed during downward reciprocating motion of the piston.

18. A machine as in claim 17 wherein the machine is a high pressure fluid pump.

19. A reciprocating piston machine including a piston fitted to a slide within a cylinder so as to define a variable volume chamber at one end of the cylinder, a pair of gudgeon/wrist pins being mounted on the piston on either side of the cylinder axis, said piston being connected by rigid means to a pair of rotationally engaged crankshafts so as to provide conversion between crankshaft rotary motion and piston reciprocating motion, wherein the rigid means comprises a plurality of connecting rods being mutually crossed, each connecting rod extending from its pivotal connection with a respective gudgeon/wrist pin on one side of the cylinder axis to a respective crankshaft on an opposite side of the cylinder axis.

* * * * *